United States Patent [19]

Blumenstein

[11] 4,429,473

[45] Feb. 7, 1984

[54] ATTRACTIVE LADIES HEELED SHOE

[76] Inventor: Kenneth Blumenstein, 110-11 Queens Blvd., Forest Hills, N.Y. 11375

[21] Appl. No.: 303,023

[22] Filed: Sep. 17, 1981

Related U.S. Application Data

[63] Continuation-in-part of Ser. No. 66,043, Aug. 13, 1979.

[51] Int. Cl.[3] ..... A43B 3/12; A43B 13/12

[52] U.S. Cl. ..... 36/11.5; 36/30 A

[58] Field of Search ..... 36/11.5, 28, 30 R, 30 A

[56] References Cited

U.S. PATENT DOCUMENTS

| | | | |
|---|---|---|---|
| 3,177,598 | 4/1965 | Ferreira | 36/30 R |
| 3,890,725 | 6/1975 | Lea et al. | 36/11.5 |
| 3,968,577 | 7/1976 | Jackson | 36/11.5 |
| 4,106,222 | 8/1978 | Houck | 36/11.5 |

*Primary Examiner*—Patrick D. Lawson

*Attorney, Agent, or Firm*—Lowe, King, Price & Becker

[57] ABSTRACT

An attractive, sleek, comfortable, light weight ladies shoe includes a hard molded, polyurethane unitary body forming an elevated heel, a shank and an outer sole. The body has a load bearing upwardly directed face and a flange extending upwardly approximately at right angles to the face from the periphery of the outer sole and shank to the exclusion of the heel. A resilient foam polyurethane soft cushion layer having a thickness of approximately one-quarter inch and an upper face as well as a bottom face bears against the load bearing face of the body. A sheet of material covers the upper face of the cushion layer and is secured to the upper face of the body underneath of the cushion. An upper is secured in place between the upwardly directed face of the body and the bottom face of the cushion layer. The flange extends above a load bearing face of the sole by approximately three-eighths of an inch so an upper surface of the sheet material is approximately coplanar with but slightly above an upper edge of the flange. The cushion layer, sheet of material and upper are held and captured in place by the flange and embedded in the body. The heel includes an interior longitudinally extending steel support post and the shank includes an interior longitudinally extending steel support plate embedded wholly within the shank.

8 Claims, 5 Drawing Figures

Fig. 3
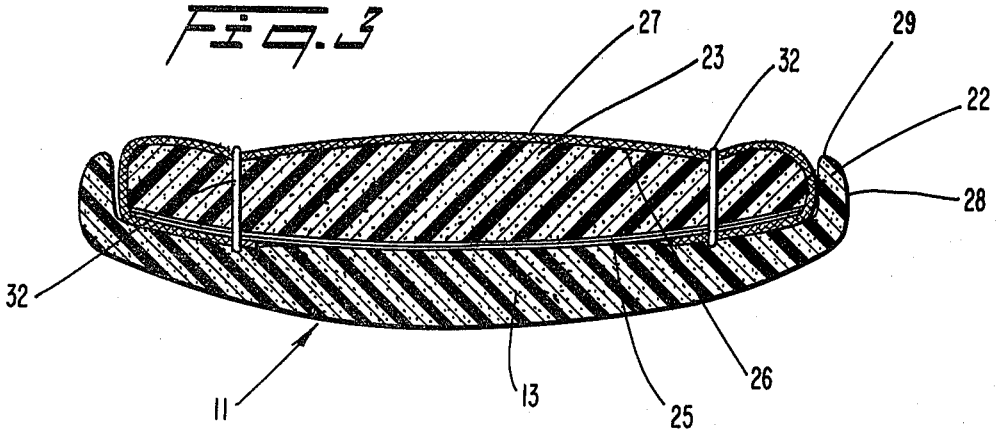
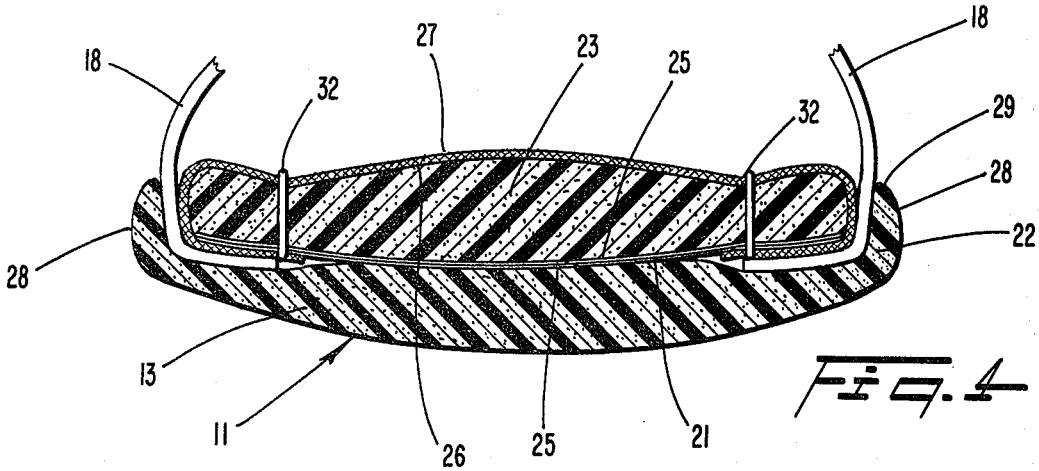
Fig. 4
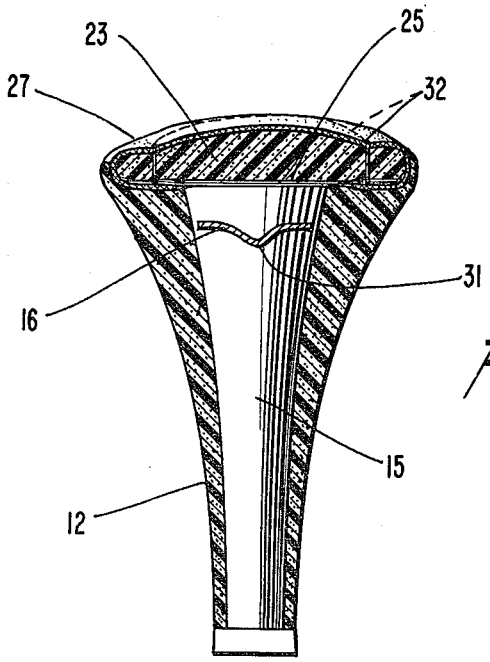
Fig. 5

ATTRACTIVE LADIES HEELED SHOE

RELATION TO CO-PENDING APPLICATION

The present application is a continuation-in-part of my co-pending application Ser. No. 066,043, filed Aug. 13, 1979, entitled Improved Outer Sole.

TECHNICAL FIELD

The present invention relates generally to ladies shoes and more particularly to a ladies shoe having a flange extending from the periphery of a load bearing face of a hard sole to capture a resilient, foam plastic, soft, cushion layer.

BACKGROUND ART

Attractive ladies shoes having elevated heels, i.e., heels between one and a half and four inches, are generally characterized by being uncomfortable because the weight of a wearer bears against a thin inner sole sheet, which in turn bears against a hard outer sole, possibly through the intermediary of a thin sole liner. The combination of the foot bearing against the hard surface of the sole, without cushioning and the unnatural, upper raised heel position frequently prevents ladies from wearing such shoes for prolonged time intervals and is often a deterrent to wearing such shoes for walking purposes.

To provide greater comfort, ladies shoes have been designed with outer soles covered by relatively thick cushions, i.e., cushions having thicknesses of more than one half inch, fabricated from various materials, such as foam, jute, and rubber. Uppers, typically formed of straps, buckles, or other conventional fastening means, as well as the cushions, are secured, by glue or sewing, to the outer sole. Such shoes generally have flat heels and almost invariably are much less attractive than shoes having medium or high heels with a hard outer sole and no cushion. In addition, it has been found that tension is exerted by the wearer upon the uppers of such shoes. The tension tends to separate the uppers, and occasionally the cushions, from the outer soles, with resulting deleterious effects on the life of the shoe.

It has also been a prior art practice to provide ladies shoes with continuous side walls around a periphery of an inner sole. This structure imparts strength and stiffness to the shoes but causes the shoe to be uncomfortable and not as attractive as shoes that do not have the continuous side walls. The lack of comfort occurs because the side wall causes irritation and chafing between the heel of the wearer and the side wall.

It is, accordingly, an object of the present invention to provide a new and improved ladies shoe.

Another object of the invention is to provide a new and improved ladies shoe that is comfortable, light weight, sleek and attractive.

A further object of the present invention is to provide a new and improved ladies shoe that is comfortable, light weight, sleek, attractive and has a relatively long life.

A further object of the present invention is to provide a new and improved ladies shoe having a medium or high heel with a hard outer sole, yet which is attractive, sleek, comfortable, light weight and is durable.

DISCLOSURE OF THE INVENTION

In accordance with the present invention, an attractive, sleek, comfortable, light weight ladies shoe includes a hard molded plastic unitary body forming an elevated heel, a shank and an outer sole. The body includes a load bearing upwardly directed face and a flange extending upwardly approximately at right angles to the load bearing face from the periphery of the outer sole. A resilient, foam, plastic, soft cushion layer having a thickness of approximately one-quarter inch includes a bottom face bearing against the load bearing face of the body. A sheet of material covering an upper face of the cushion is secured to the upper face of the body underneath of the cushion. An upper is secured in place between the upwardly directed, load bearing face of the body and the bottom face of the cushion layer. The flange extends above a load bearing face of the sole by approximately three-eights of an inch so an upper surface of the sheet material is approximately co-planar with but slightly above an upper edge of the flange. The cushion layer, sheet of material and upper are held and captured in place by the flange and embedded in the body. Because the upper surface of the sheet material is slightly above an upper edge of the flange, the foot of the wearer does not contact the relatively sharp upper edge of the flange, to maximize comfort of the wearer.

The resulting shoe is attractive, sleek and light weight because the thin cushion layer, preferably formed of polyurethane, absorbs a substantial amount of shock of the wearer during walking. The cushion layer can be relatively thin because it is held and captured in place by the flange and embedded in the hard, molded, plastic unitary body forming the elevated heel, shank and outer sole, which body is preferably formed of hard polyurethane. The flange also holds the sheet material, which in effect forms an inner sole, and the upper in place and captures them to increase the life of the shoe.

To provide additional strength to the shoe, the heel includes an interior, longitudinally extending support post, preferably formed of steel, and the shank includes an interior, longitudinally support plate, preferably formed of steel. The post and plate provide increased rigidity to the shoe, without adversely effecting the appearance of the shoe because the post and shank are not visible and do not effect the apparent bulk of the shoe.

A sole liner is positioned between the bottom face of the cushion layer and the upper face of the body. The sole liner assists in preventing relative movement between the cushion layer and the hard body forming the elevated heel, shank and outer sole.

It is, therefore, a further object of the invention to provide a new and improved ladies shoe having an outer sole with an improved structure for holding and capturing a shock absorbing cushion in place.

An additional object of the invention is to provide a new and improved ladies shoe having an outer sole with a structure for holding and capturing a cushion layer, upper and sheet forming an outer sole in place.

The above and still further objects, features and advantages of the present invention will become apparent upon consideration of the following detailed description of one specific embodiment thereof, especially when taken in conjunction with the accompanying drawings.

BRIEF DESCRIPTION OF THE DRAWINGS

FIG. 3 is a cross-sectional view taken through the lines 3—3, in FIG. 1;

FIG. 4 is a cross-sectional view taken through the lines 4—4, FIG. 1; and

FIG. 5 is a cross-sectional view taken through the lines 5—5, FIG. 1.

BEST MODE FOR CARRYING OUT THE INVENTION

Figure 1:
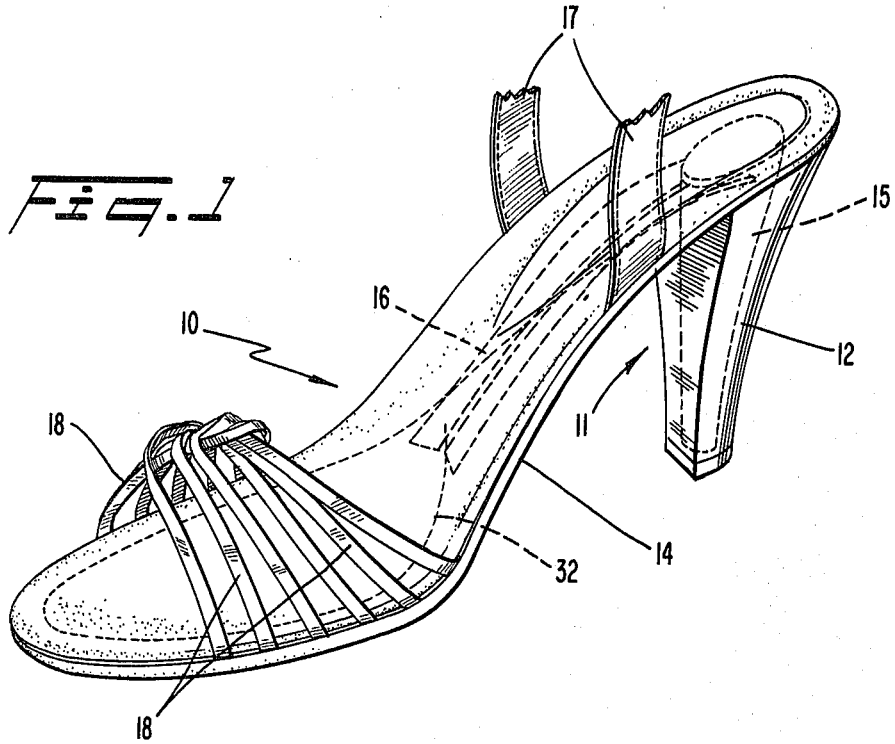
FIG. 1 is a perspective view of a ladies shoe in accordance with a preferred embodiment of the invention.
Figure 2:
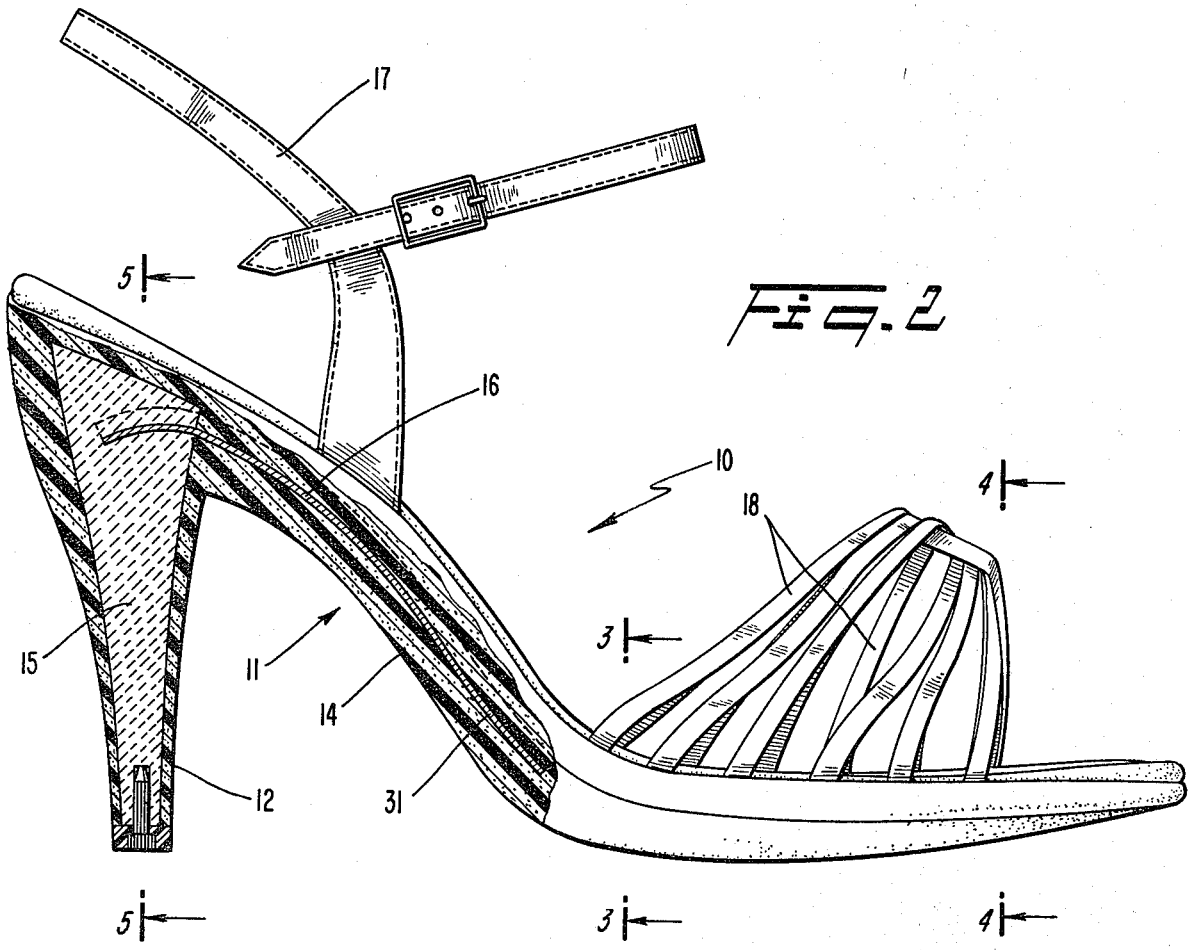
FIG. 2 is a side view of the shoe illustrated in FIG. 1, with certain portions in cross section.

Reference is now made to FIGS. 1 and 2 of the drawing wherein an attractive, sleek, comfortable and light weight ladies shoe 10 is illustrated as including a hard, molded, plastic unitary, relatively flexible body 11 forming an elevated heel 12, an outer sole 13 and a shank 14 which connects the heel and outer sole together. Body 11 is preferably molded from relatively dense polyurethane, but it is to be understood that other suitable materials can be employed. Typically, heel 12 has a height between 1½ and 4 inches. Located interiorly of heel 12 is cylindrical steel post 15, having a diameter of approximately one-half inch and a longitudinal axis that extends vertically in generally the same direction as the heel longitudinal axis; post 15 extends through heel 12 from approximately just below the top of the heel to within one-half inch to one inch from the bottom of the heel. Post 15 is fixedly connected to a rearward portion of steel shank plate 16 that extends longitudinally in the same direction as shank portion 14 of body 11. The rear portion of shank plate 16 extends into and is captured by post 15 slightly below the top of the post. Plate 16 extends approximately two-thirds of the way through the thickness of post 15 and is bent downwardly in the post; this combination of factors positively stabilizes the position of the plate. Shank plate 16 has a thickness of approximately one-sixteenth inch, is embedded wholly within shank portion 14 and includes a central, longitudinally extending rib 31 for strength.

Attached to body 11 is an upper including a buckle strap 17 that extends from shank portion 14. The upper also includes toe straps 18, secured to outer sole 13. Buckle straps 17 and toe strap 18 of the upper are formed of sheet material, such as leather, cloth, or a suitable flexible plastic.

As best illustrated in FIGS. 3 and 4, body 11 includes a load bearing, upwardly directed face 21. Extending approximately at right angles from the periphery of face 21 along outer sole 13 and shank 14 is flange 22, that is unitary with body 11. Flange 22 extends above face 21 by approximately three-eights of an inch, i.e., between approximately a quarter of an inch and approximately a half an inch so that the height thereof is not easily noted, to enhance the attractive nature of the shoe. Flange 22, in combination with outer sole 13 and shank 14, forms a cup for receiving a flexible, resilient, foam, soft plastic, preferably polyurethane, cushion layer 23, preferably having a thickness of approximately one-quarter of an inch. Flange 22 seals cushion layer 23, sole liner 25 and the side of material 27 from exposure to adverse environmental effects, such as water due to rain and snow. Cushion layer 23 has a bottom face 24 bearing against upper face 21 of body 11. Between faces 21 and 24 is sole liner sheet 25, preferably formed of paper or thin cardboard. Face 24 is considered as bearing against face 21 even though the faces are not in direct contact because sheet 25 is so thin that the weight of the cushion is actually carried by face 21 of body 11, rather than by sheet 25.

Covering upper face 26 of cushion layer 23 is sheet 27, formed of canvas, cloth, leather, nylon, polyurethane, or any other suitable material, to form an inner sole for shoe 10. Together, layer 23, liner sheet 25 and inner sole sheet 27 have a total height slightly greater than the height of flange 22. Thereby the upper surface of sheet 27 is approximately coplanar with, but slightly above, (e.g., approximately one-sixteenth inch under no load circumstances) upper edge 29 of flange 22.

Sole liner 25 is secured, preferably by gluing, to upper face 21. Lower face 24 of cushion layer 23 is glued to sole liner 25. Sheet 27 and sole liner 25 are respectively secured to upper face 26 of cushion layer 23 and the lower face of layer 23 by gluing and stitches 32. It is not possible to stitch cushion layer 23 and sole liner 25 to body 11 because the body is made of a material that is too hard to receive such stitching. Sheet 27 extends around the edges of cushion layer 23, in abutting relation with these edges and interior wall 28 of flange 22. The edges of sheet 27 are glued to body 11, underneath of sole liner 25. The thickness of sheet 27 is such that the sides of cushion layer 23 bear against side walls 28 of flange 22, particularly when a wearer compresses the cushion layer while shoe 10 is in use. Cushion layer 23, and sheet 27 are held and captured in place by side wall 28 of flange 22, to cause them to be embedded in body 11.

To preserve the sleek nature of the shoe, flange 22 is tapered to have a relatively sharp upper edge 29. This construction of flange does not cause abrasive rubbing between upper flange edge 29 and the foot of the wearer because the upper face of inner sole sheet 27 is slightly above the flange.

As illustrated in FIG. 4, upper strap 18 fits between wall 28 of flange 22 and the portion of sheet 27 that is tucked along the side wall of cushion layer 23. Strap 18 is, however, thin enough to enable cushion layer 23 to bear against flange 22 through layer 27 as well as strap 18, particularly when the shoe is being worn. A similar configuration (not shown) holds upper buckle strap 17 in situ. Thereby, upper portions 17 and 18, as well as sheet 27 and cushion 23 are held and captured in place by flange 22.

As illustrated in FIG. 5, body 11 is fabricated so that flange 22 does not extend above heel 12. Instead, above heel 12, body 11 is flat, with material 27 being tucked beneath cushion layer 23, which is glued to sole liner 25. Such a construction facilitates manufacture of a mold and the molding operation, but does not have a deleterious effect on securing cushion 23, material 27 and the upper portions 17 and 18 in situ. While sheet 25 and cushion 23 cause material 27 to project slightly above the top edge of heel 15, the projection is not enough to detract from the attractive appearance of the shoe. The substantially flush relationship between the top face of material 27 and top edge 29 of flange 22, wherein the difference between the top face of the material and top edge of the flange is no more than an eighth of an inch, provides the shoe with a sleek and attractive appearance.

While there has been described and illustrated one specific embodiment of the invention, it will be clear that variations in the details of the embodiment specifically illustrated and described may be made without departing from the true spirit and scope of the invention as defined in the appended claims.

I claim:

1. An attractive, sleek, comfortable, light weight ladies shoe comprising a hard molded, plastic unitary body forming an elevated heel, a shank and an outer sole; said body having a load bearing upwardly directed face and a flange extending upwardly approximately at right angles to the face and from the periphery of the outer sole; a resilient foam plastic soft cushion layer having a thickness of approximately one-quarter inch and an upper face as well as a bottom face bearing against the load bearing face of the body; a sheet of material covering the upper face of the cushion layer and secured to the upper face of the body underneath of the cushion; an upper secured in place between the upwardly directed face of the body and the bottom face of the cushion layer; the flange extending above a load bearing face of the sole by approximately three-eights of an inch so an upper surface of the sheet material is approximately coplanar with but slightly above an upper edge of the flange and the cushion layer, sheet of material and upper are held and captured in place by the flange and embedded in the body.

2. The shoe of claim 1 wherein a sheet of sole liner is positioned between the bottom face of the cushion layer and the upper face of the body.

3. The shoe of claim 1 wherein the heel includes an interior longitudinally extending support post and the shank includes an interior longitudinally extending support plate embedded wholly within the shank.

4. The shoe of claim 3 wherein the post and plate are steel.

5. The shoe of claim 1, 2, 3 or 4 wherein the cushion layer is polyurethane.

6. The shoe of claim 1, 2, 3, or 4 wherein the body is polyurethane.

7. The shoe of claim 1 wherein the flange extends only around the periphery of the shank and sole, to the exclusion of the heel.

8. The shoe of claim 1 or 7 wherein the flange is tapered to have a relatively sharp upper edge.

* * * * *

UNITED STATES PATENT AND TRADEMARK OFFICE

CERTIFICATE OF CORRECTION

PATENT NO. : 4,429,473

DATED : February 7, 1984

INVENTOR(S) : Kenneth Blumenstein

It is certified that error appears in the above-identified patent and that said Letters Patent is hereby corrected as shown below:

On the title page, Item /54/ should read:

[54] SHOE WITH EMBEDDED CUSHION CONSTRUCTION

Signed and Sealed this

First Day of May 1984

[SEAL]

*Attest:*

GERALD J. MOSSINGHOFF

*Attesting Officer*

*Commissioner of Patents and Trademarks*